US006176028B1

(12) United States Patent
Walsh et al.

(10) Patent No.: US 6,176,028 B1
(45) Date of Patent: Jan. 23, 2001

(54) ROLL-UP INFORMATION DISPLAY

(75) Inventors: Robert M. Walsh, Flower Mound; Leo C. Squiers, Grapevine, both of TX (US)

(73) Assignee: FrontLine, Inc, Grapevine, TX (US)

( * ) Notice: Under 35 U.S.C. 154(b), the term of this patent shall be extended for 0 days.

(21) Appl. No.: 09/507,741

(22) Filed: Feb. 22, 2000

(51) Int. Cl.[7] ..... G09F 11/21
(52) U.S. Cl. ..... 40/514; 70/515; 160/121.1
(58) Field of Search ..... 40/514, 515; 160/121.1, 160/243

(56) References Cited

U.S. PATENT DOCUMENTS 3,183,033 * 5/1965 Stulbach ..... 160/121.1
4,344,474 * 8/1982 Berman ..... 160/121.1
5,966,854 * 10/1999 Walsh et al. ..... 40/514

* cited by examiner

*Primary Examiner*—Cassandra H. Davis
(74) *Attorney, Agent, or Firm*—John E. Vandigriff

(57) ABSTRACT

A pull-down display that can be mounted, for example, in the price strip on a shelf, or on a shopping cart is a two piece plastic material that is self coiling so that the display media will roll itself up after being pulled down and then released. One of the two pieces of display media is securely fastened to a mounting bracket at one end and is attached to a tube at the other end. The other piece of display media is loosely or slidably attached to the mounting bracket and is attached to the tube at the other end. A display or advertisement is placed between the two pieces of self-coiling display media and prevented from upward movement by a retainer strip when the display media is coiling upward.

15 Claims, 4 Drawing Sheets

ROLL-UP INFORMATION DISPLAY

CROSS-REFERENCE

U.S. Pat. No. 5,966,854

FIELD OF THE INVENTION

This invention relates to roll-up information display devices, and more particularly to an information display that utilizes a self roll-up display media.

BACKGROUND OF THE INVENTION

Roll-up display signs have been utilized in a number of configurations where the display media is mounted on a roller device that includes a spring to cause the display media to roll around a cylinder or tubular mount. For example, in U.S. Pat. No. 4,292,752, a display is mounted on a spring biased roller and is held in an open or rolled down position by a clip attached around a bracket. Because of the spring biased roller, the display media will roll-up when the hold down clip is release from the bracket.

A similar device is described in U.S. Pat. No. 2,351,822, in which a display device is mounted on a cylindrically shaped rod that is mounted by and biased with an elastic band. When the display is pulled downward, unrolling the display, the elastic band is twisted. When the display is released, the twisted elastic band will cause the display to wind up around the cylindrically shaped rod.

SUMMARY OF THE INVENTION

The invention is a pull-down display that can be mounted, for example, in the price strip on a shelf, or on a shopping cart. The display media is a two piece plastic material that is self-coiling so that the display media will roll itself up after being pulled down and then released. One of the two pieces of display media is securely fastened to a mounting bracket at one end and is attached to a tube at the other end. The other piece of display media is loosely or slidably attached to the mounting bracket and is attached to the tube at the other end. A display or advertisement is placed between the two pieces of self-coiling display media and prevented from upward movement when the display media is coiling upward by a stop which extends a small distance over the top of the advertisement material. A pull-down handle is loosely mounted in the tube so that the display media will coil around the tube when released.

DESCRIPTION OF A PREFERRED EMBODIMENT

Figure 1:
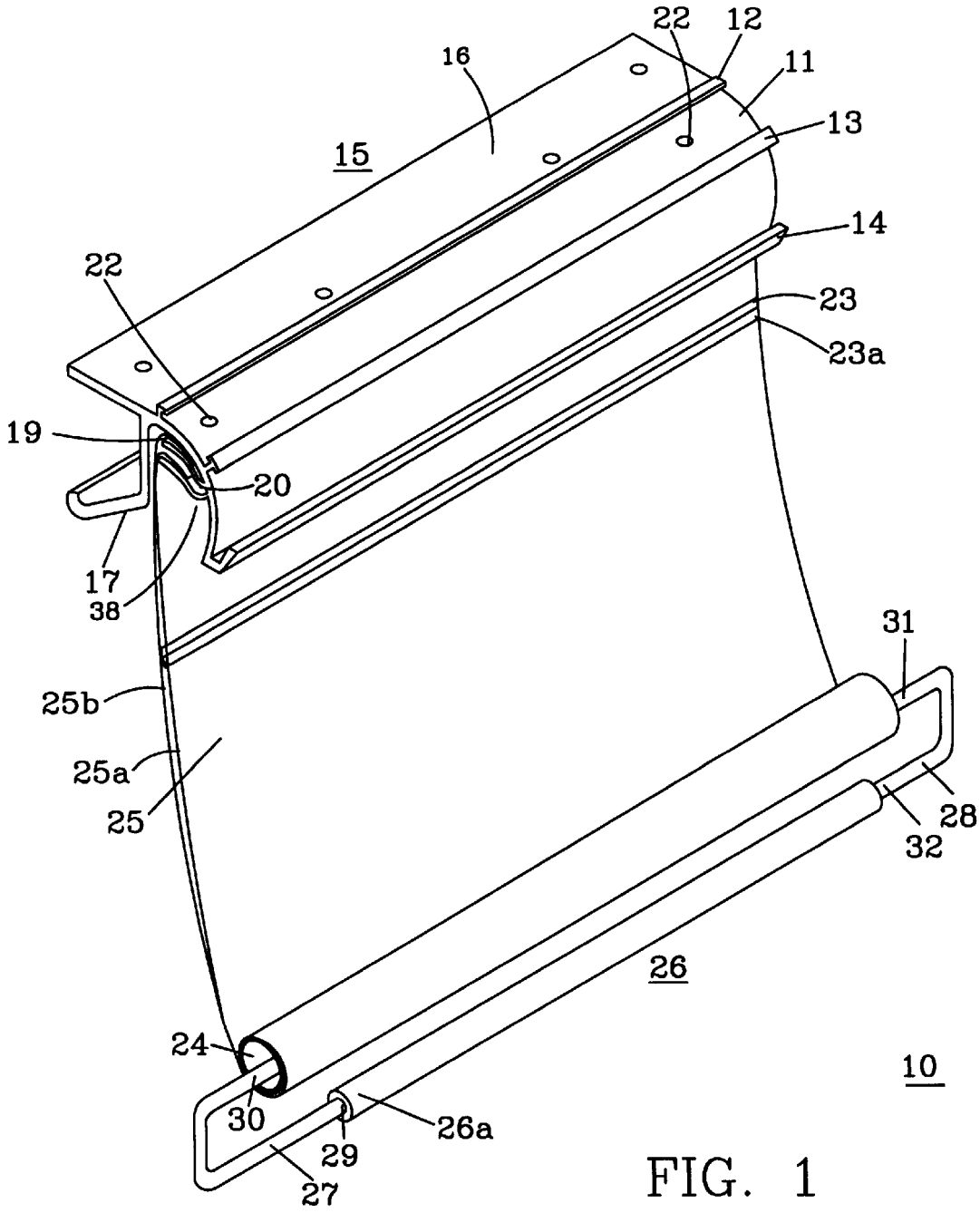
FIG. 1 shows the roll-up display device of the invention in a pulled-down position.

FIG. 1 shows the display device 10 of the present invention in an extended or pulled-down position. Display device 10 has a frame 15 which has a curved of semicircular cover 11 reenforced by ribs 12, 13 and 14. Ribs 12, 13 and 14 may also be used to hold notices or product information. Such information is placed on cards that may be placed between two ribs and held in place by the ribs. For example, a notice is placed between ribs 13 and 14 indicating that a map of the store showing the location of products is on the roll-down display.

Frame 15 also has an extension 16 and 17 which are used for mounting display 10 to a shelf or other location. Various ways may be used to mount display 10, such as screws or clamps. Display media 25 is made up of two pieces 25*a,* 25*b* of a self-coiling material, for example, polyvinyl chloride (PVC). While the material thickness is not critical, it may be in a range including 10 mils thick.

Display media pieces 25*a,* 25*b* are a plastic material that is self-coiling material so that it is rolled-up in its normal state. Display media 25*a* is attached to frame 15 in slot or channel 19 on one end and is attached to a tube 24 on its other end. Display media 25*b* is attached to frame 15 in slot or channel 20 on one end and is attached to a tube 24 on its other end. Extending across media 26*b* is a strip of material that is attached to 25*b.* An edge 23*a* of strip 23 is not attached to media 25*b.* The, upper edge of advertising media inserted between 25*a* and 26*b* is placed under strip 23*a* to prevent the advertising media from migrating upward when the two pieces of media 25*a* and 25*b* coil upward. Media 25*a* will tend to move upward with respect to 25*b* when coiling upward. Strip 23*a* keeps the advertising media between 25*a* and 25*b* from moving upward when 25*a* moves upward with respect 25*b.*

The ends of 25*a* and 25*b* may be attached with an adhesive or may be attached with brads or rivets to tube 24, or to an outer cylinder extending partially around tube 24. A handle 26 is movably mounted in tube 24 by two brackets 27 and 28. Bracket 27 has an end mounted in a channel 26*b* (FIG. 4) in handle tube 26*a,* and another end 30 extends into the open end of tube 24. Similarly, a second bracket 28 has one end mounted in handle tube 26*a* and another end in tube 24. Both bracket ends 30 and 31 extend loosely into tube 24 and are not physically attached to tube 24. When a person pulls downward on handle 26, display media 25 will roll out or unwind from around tube 24 as shown in FIG. 1. When handle 26 is released, display media 25 will coil itself around tube 24 and move into the semicircular space 38 in frame 15.

Figure 2:
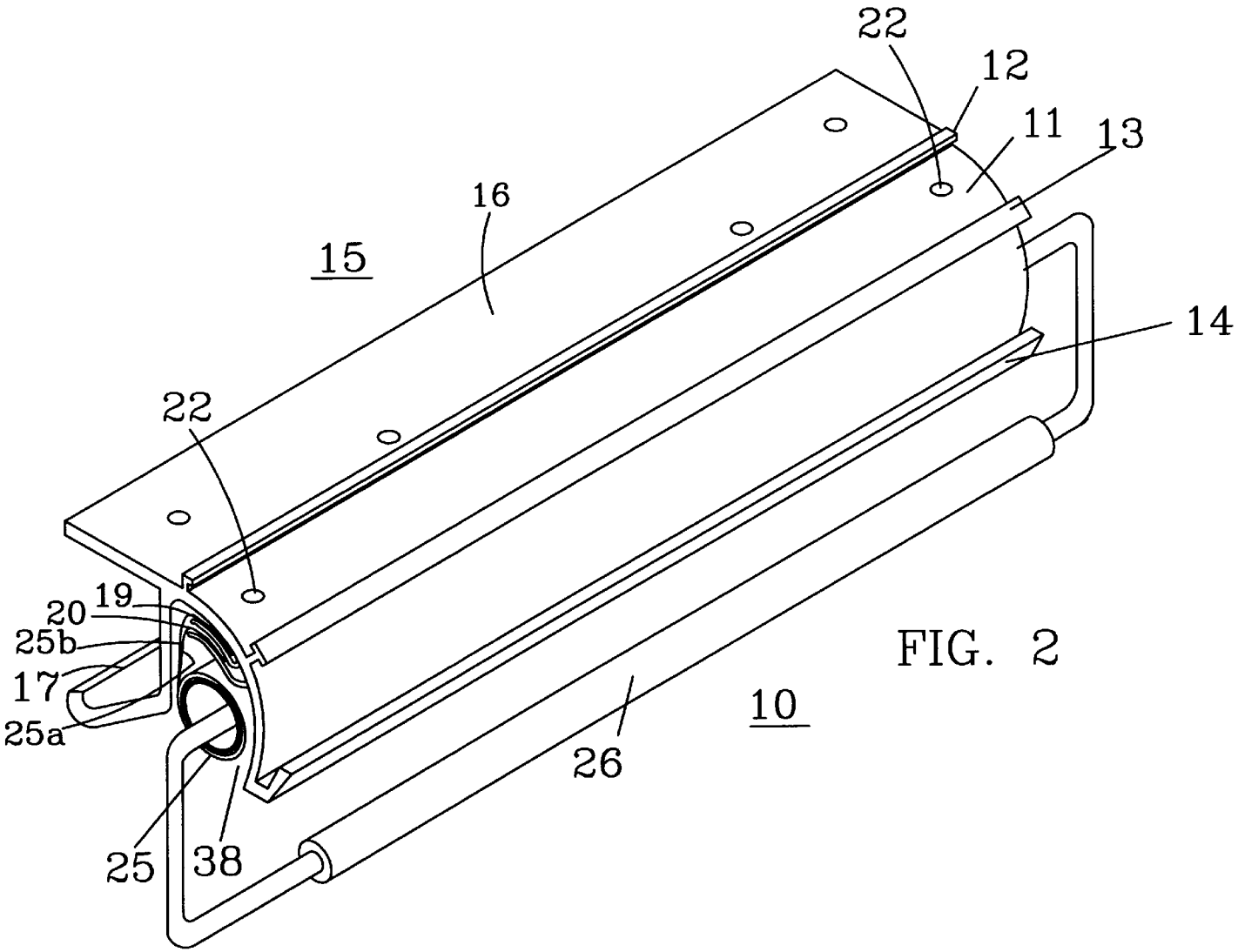
FIG. 2 shows the roll-up display device with the display media coiled-up in the mounting bracket.

FIG. 2 shows display device 10 with media 25 rolled-up or coiled into the storage position in semicircular area 38. When media 25 is rolled into a coil, it is pulled down by pulling on handle 26. Since media 25 is a self-coiling material, it will remain in the stored position, as shown, until it is pulled down out of the semicircular area 38.

Figure 3:
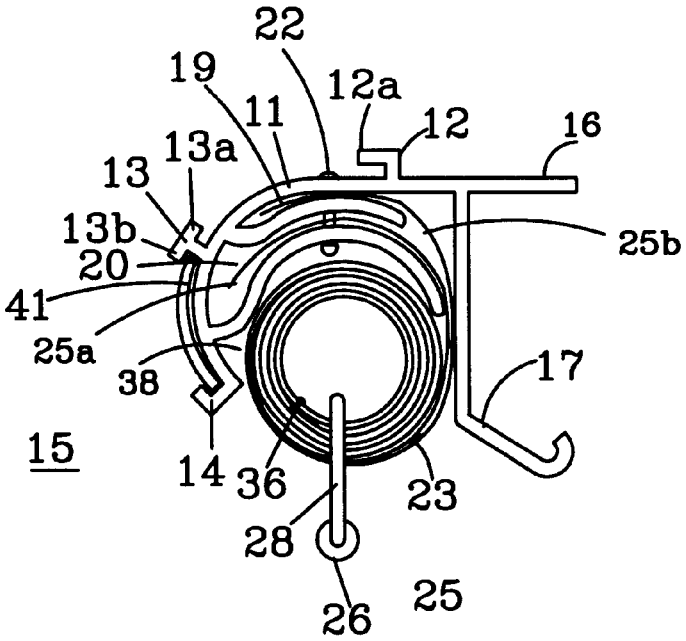
FIG. 3 is an end view of the display device.

FIG. 3 is a end view of display device 10 with media 25*a,* 25*b* coiled up into area 38. Media 25*a* is loosely attached in slot 20 of frame 15 by rivet or screw 22. There is at least one rivet 22 on each end of frame 15 so that media 25*a* is loosely secured to at least two points in slot 17. Media 25*b* is securely attached in slot 19 of frame 15 by rivet or screw 22. There is at least one rivet 22 on each end of frame 15 so that media 25*b* is secured to at least two points in slot 19.

Figure 3A:
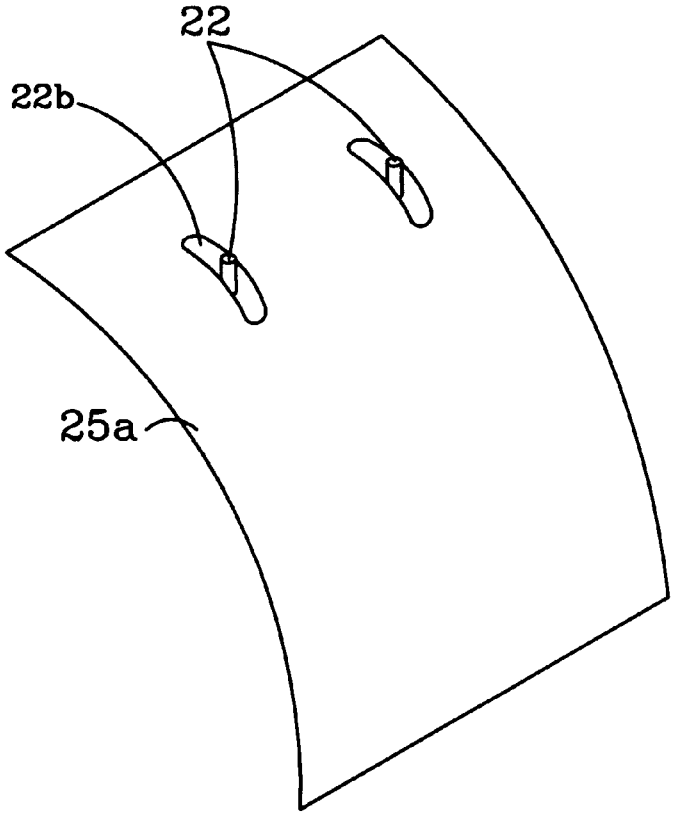
FIG. 3A shows the slot in one of the sheets of display media.

The opening 22*a* in media 25*a* through which the fastener 22 extends is slotted to allow the movement or migration of media 25*a* as it rolls upward with media 25*b.* A partial view of media 25*a* is shown in FIG. 3*a,* showing the slot or opening 22*a* in media 25*a* through which the pin 22 is inserted that holds media 25*a* in slot 20 of frame 15.

Media 25*a* and 25*b* are attached to tube 24 by any suitable means such as glueing, taping or a fastener, such as fastener 36. There may be several fasteners along the edge of media

25 where it is fastened to tube 24. Handle 26 is suspended from tube 24 by brackets 28 and 27 (FIG. 1).

Cover 11 has ribs 12–14 that are used to reenforce cover 11 and each rib 12–14 has an extended end. For example rib 12 has extended end 12*a,* rib 13 has extended ends 13*a* and 13*b,* and rib 14 has extended end 14*a.* Display cards may be inserted in the space between the ribs 12–14 and held in place by the extended ends. For example a card 41 is between ribs 13 and 14 and held in place by ends 13*b* and 14*a.*

Figure 4:
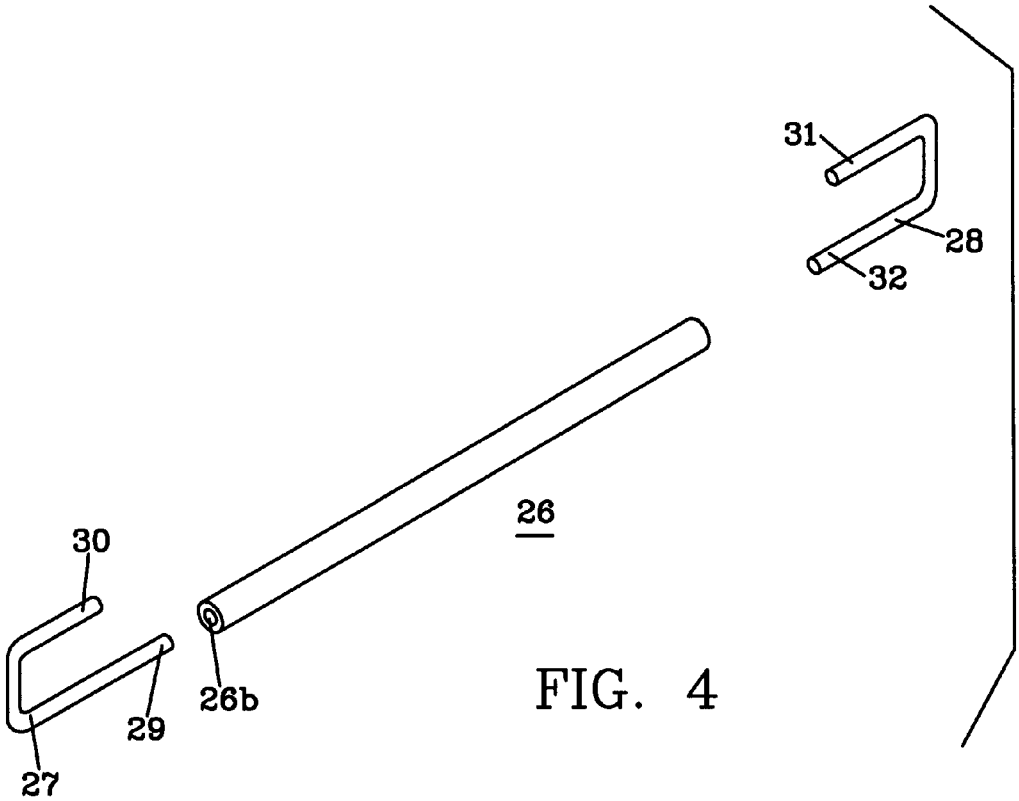
FIG. 4 shows the pull-down handle.

FIG. 4 is an exploded view of handle 26 and brackets 27 and 28. Handle 26 is a hollow tube, at least on each end. A first bracket 27 has an end 29 that is inserted into opening 26*b.* A second bracket 28 has an end 32 that is inserted into tube 26. Bracket ends 30 and 31 are inserted into the ends of tube 24 to which display media 25 is attached. Bracket ends 30 and 31 are loosely inserted into tube 24 so that media 25 can coil itself around tube 24 and handle 26 will remain in the downward suspended position as shown in FIGS. 1–3.

In use, the display media 25 may have printed information inserted between media 25*a* and 25*b.* This printed information may be changed out as desired to present different sales or other information from time to time.

What is claimed:

1. A roll-up display device, comprising:

a mounting frame with a pair of slots therein;

a two piece self-coiling display media attached by a first end of each piece to said frame in different ones of said slots in said mounting frame, and said two piece self-coiling display media attached at a second end to a tube; and a handle suspended from said second end of said two piece display media for pulling said two piece display media to an extended uncoiled position;

wherein when said two piece self-coiling media is in an extend position, and the handle is released, the self-coiling media will coil itself upward and around said tube.

2. The display device according to claim 1, wherein one piece of said two piece self-coiling display media has a retention strip mounted thereon for hold an advertising media in place when the two piece self-coiling display media coil upward.

3. The display device according to claim 1, including at least one bracket for attaching said display device to an object.

4. The display device according to claim 1, wherein a portion of said handle is inserted into and movably suspended from said tube.

5. The display device according to claim 1, wherein said handle includes a tubular handle and two brackets, one attached to each end of said tubular handle.

6. The display device according to claim 1, wherein said cover has ribs thereon between which information tags may be mounted.

7. The display device according to claim 1, wherein said display media is a self-coiling plastic material.

8. A roll-up display device, comprising:

a mounting frame with a pair of slots therein;

a two piece self-coiling display media attached by a first end of each piece to said frame in different ones of said slots in said mounting frame, and said two piece self-coiling display media attached at a second end to a tube; and a handle suspended from said second end of said two piece display media for pulling said two piece display media to an extended uncoiled position.

9. The display device according to claim 8, wherein one piece of said two piece self-coiling display media has a retention stip mounted thereon for hold an advertising media in place when the two piece self-coiling display media coil upward.

10. The display device according to claim 8, including at least one bracket for attaching said display device to an object.

11. The display device according to claim 8, wherein said handle is movably suspended from said tube.

12. The display device according to claim 8, wherein said handle includes a tubular handle and two brackets, one bracket attached to each end of said tubular handle and extending into said tube.

13. The display device according to claim 8, including ribs on said mounting frame, said ribs providing a mounting area between the ribs on which information tags may be mounted.

14. The display device according to claim 8, wherein said display media is a self-coiling plastic material.

15. A roll-up display device, comprising:

a mounting frame;

a two piece self-coiling display media attached by a first end of each piece to said frame in different ones of said slots in said mounting frame, and said two piece self-coiling display media attached at a second end to a tube; and a handle suspended from said tube for pulling said two piece display media to an extended uncoiled position;

wherein when said two piece self-coiling display media is in an extend position, and the handle is released, the two piece self-coiling display media will coil itself upward and around said tube.

* * * * *